US007353890B2

(12) United States Patent
Shofner

(10) Patent No.: US 7,353,890 B2
(45) Date of Patent: Apr. 8, 2008

(54) DOWN-THE-HOLE HAMMER AND COMPONENTS FOR A DOWN-THE-HOLE HAMMER, AND A METHOD OF ASSEMBLING A DOWN-THE-HOLE HAMMER

(75) Inventor: Matthew Floyd Shofner, Mansfield, TX (US)

(73) Assignee: Sandvik Intellectual Property AB, Sandviken (SE)

( * ) Notice: Subject to any disclaimer, the term of this patent is extended or adjusted under 35 U.S.C. 154(b) by 130 days.

(21) Appl. No.: 11/306,714

(22) Filed: Jan. 9, 2006

(65) Prior Publication Data

US 2007/0158113 A1 Jul. 12, 2007

(51) Int. Cl.
*E21B 4/14* (2006.01)

(52) U.S. Cl. ..... 175/296; 175/99; 175/92; 175/293; 173/17

(58) Field of Classification Search ..... 175/92, 175/99, 293, 296; 173/17, 204, 92, 91
See application file for complete search history.

(56) References Cited

U.S. PATENT DOCUMENTS

| | | | | |
|---|---|---|---|---|
| 4,015,670 | A | 4/1977 | Rear | |
| 4,530,407 | A | 7/1985 | Rear | |
| 4,790,390 | A | 12/1988 | Sweeny | |
| 5,205,363 | A * | 4/1993 | Pascale | 173/17 |
| 5,407,021 | A | 4/1995 | Kane et al. | |
| 6,062,322 | A | 5/2000 | Beccu et al. | |
| 6,131,672 | A | 10/2000 | Beccu et al. | |
| 6,454,026 | B1 | 9/2002 | Shofner | |
| 6,499,544 | B1 | 12/2002 | Shofner | |

FOREIGN PATENT DOCUMENTS

| | | | |
|---|---|---|---|
| EP | 0048142 | A1 | 3/1982 |
| WO | 9957411 | A1 | 11/1999 |
| WO | 03029601 | A2 | 4/2003 |

OTHER PUBLICATIONS

International Search Report and Written Opinion from corresponding International Application PCT/SE2006/001382.

* cited by examiner

*Primary Examiner*—Jennifer H Gay
*Assistant Examiner*—Brad Harcourt
(74) *Attorney, Agent, or Firm*—WRB-IP LLP

(57) ABSTRACT

A down-the-hole hammer includes a casing and a piston movable in the casing between a lowermost operating position and an uppermost operating position. A recess is provided between the piston and the casing so that the piston and the casing define an intermediate chamber between a top end of the piston and a bottom end of the piston. A passageway is provided between a source of pressurized fluid and the intermediate chamber such that, at all positions of the piston between the lowermost and the uppermost operating positions, the source of pressurized fluid is in flow communication with the intermediate chamber through the passageway. An opening in the piston at least partially defines the passageway.

28 Claims, 5 Drawing Sheets

DOWN-THE-HOLE HAMMER AND COMPONENTS FOR A DOWN-THE-HOLE HAMMER, AND A METHOD OF ASSEMBLING A DOWN-THE-HOLE HAMMER

The present invention relates to down-the-hole hammers and components therefor and, more particularly, to down-the-hole hammers and components having central feed tubes and intermediate chambers defined by recesses between piston and casing walls.

U.S. Pat. No. 6,131,672, which is incorporated by reference, discloses a percussive down-the-hole hammer wherein pressurized fluid is routed through the center of the piston and is directed to either the top or the bottom of the piston from the center of the piston through holes formed in the piston. Pressurized fluid is held in the central feed tube until ports open, allowing it to travel the distance to the upper or lower chambers to act on the piston. While this design provides for a low cost outer casing that does not require complex machining to direct the air to the upper and lower chambers, the air must travel a substantial distance to act on the piston.

Other down-the-hole hammer designs utilize an intermediate chamber formed in the outer diameter of the piston. Pressurized fluid is supplied to the intermediate chamber through openings provided in the casing. While such intermediate chamber designs can reduce the distance that pressurized fluid must travel to reach the upper and lower chambers and act on the piston, they involve complex machining of the casing to feed the intermediate chamber, which can be expensive to manufacture and, because it is a wear item, it can also be expensive to replace.

U.S. Pat. No. 4,015,670, which is incorporated by reference, discloses a down-the-hole hammer design utilizing an intermediate chamber formed in an outer diameter of a piston, with pressurized fluid being intermittently provided to the intermediate chamber as radial openings in the piston align with radial openings in a feed tube. When the feed tube radial openings align with one of the radial openings in the piston, air flows to a chamber above the piston and, when the feed tube radial openings align with the other one of the radial openings in the piston, air flows to a chamber below the piston.

According to an aspect of the present invention, a down-the-hole hammer comprises a casing and a piston movable in the casing between a lowermost operating position and an uppermost operating position. A recess is provided between the piston and the casing so that the piston and the casing define an intermediate chamber between a top end of the piston and a bottom end of the piston. A passageway is provided between a source of pressurized fluid and the intermediate chamber such that, at all positions of the piston between the lowermost and the uppermost operating positions, the source of pressurized fluid is in flow communication with the intermediate chamber through the passageway. An opening in the piston at least partially defines the passageway.

According to another aspect of the invention, a down-the-hole hammer comprises a casing, a feed tube disposed in the casing and adapted to be connected to a source of high pressure fluid, and a piston movable in the casing and having an end opening in which the feed tube is movable upon reciprocation of the piston. A fluid feed passage is at least partially defined by the piston for permitting fluid to flow from the feed tube to a top chamber above the piston when in a first range of positions relative to the casing and to a bottom chamber below the piston when in a second range of positions relative to the casing. A fluid vent passage is provided for permitting fluid to vent from the top chamber when the piston is below the first range of positions, the fluid vent passage being at least partially defined by the piston and discrete from the fluid feed passage.

According to another aspect of the present invention, a piston for a down-the-hole hammer comprises a body having a top end and a bottom end and an intermediate surface between the top end and the bottom end. An opening extends from the top end to the bottom end of the body, the opening having a primary diameter and a recessed portion having a diameter larger than the primary diameter. A radial passage extends from the opening to the intermediate surface. A passage extends from the top end to the opening.

According to another aspect of the present invention, a method of assembling a down-the-hole hammer comprises positioning a piston in a casing such that the piston is movable in the casing between a lowermost operating position and an uppermost operating position. A recess is provided between the piston and the casing so that the piston and the casing define an intermediate chamber between a top end of the piston and a bottom end of the piston. A passageway is provided between a source of pressurized fluid and the intermediate chamber such that, at all positions of the piston between the lowermost and the uppermost operating positions, the source of pressurized fluid is in flow communication with the intermediate chamber through the passageway, an opening in the piston at least partially defining the passageway.

According to another aspect of the present invention, a method of assembling a down-the-hole hammer comprises providing a casing having a feed tube disposed in the casing, the feed tube being adapted to be connected to a source of high pressure fluid. A piston is movably positioned in the casing such that the feed tube is movably positioned in an end opening of the piston and such that the piston and the feed tube at least partially define a fluid feed passage for permitting fluid to flow from the feed tube to a top chamber above the piston when in a first range of positions relative to the casing and to a bottom chamber below the piston when in a second range of positions relative to the casing; and such that a fluid vent passage is formed for permitting fluid to vent from the top chamber when the piston is below the first range of positions, the fluid vent passage being at least partially defined by the piston and discrete from the fluid feed passage.

BRIEF DESCRIPTION OF THE DRAWINGS

The features and advantages of the present invention are well understood by reading the following detailed description in conjunction with the drawings in which like numerals indicate similar elements and in which.

DETAILED DESCRIPTION

Figure 1A:
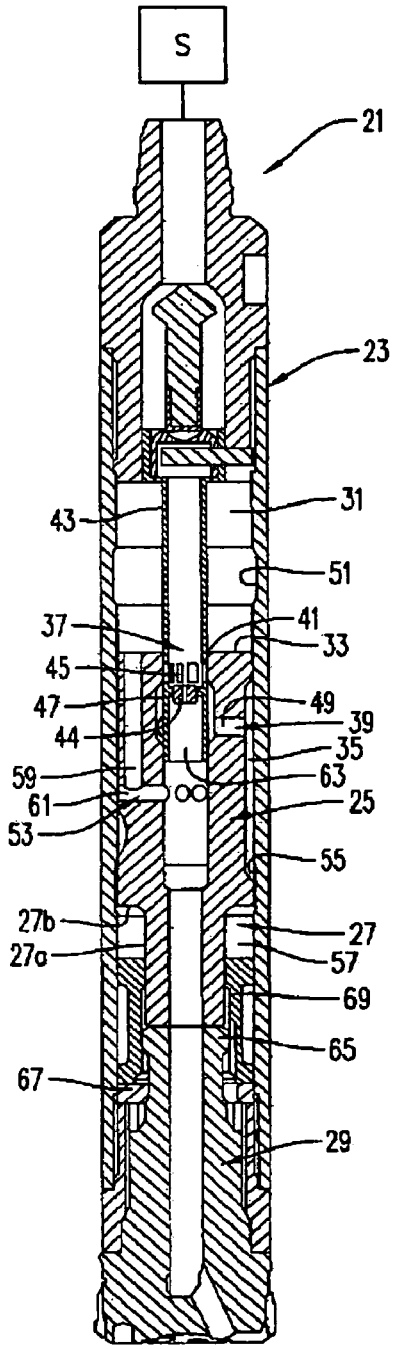
FIGS. 1A-1E are side, cross-sectional views of a down-the-hole hammer according to an embodiment of the present invention showing a piston in various positions relative to a casing.

A down-the-hole hammer 21 according to an embodiment of the present invention is shown in FIGS. 1A-1E. The down-the-hole hammer 21 includes a casing 23 and a piston 25 movable in the casing between a lowermost operating position (FIG. 1A) in which the bottom end 27 of the piston impacts a drill bit 29 and an uppermost operating position (FIG. 1D) at which a volume of a top chamber 31 defined in part by the casing and top end 33 of the piston is at a minimum.

A recess 34 is provided between the piston 25 and the casing 23 so that the piston and the casing define an intermediate chamber 35 between a top end 33 of the piston and a bottom end 27 of the piston. In the embodiment of FIGS. 1A-1E, the recess 34 is provided in the piston 25. Details of such a piston 25 are shown in FIGS. 2A-2B. However, in other embodiments, such as is shown in phantom in FIG. 3, the recess 34*a* can be provided in the casing 23 and/or in both the piston and the casing. The recesses can extend entirely or partially around a circumference of the piston exterior or the casing interior as necessary to support the piston relative to the piston while also permitting air flow necessary for reciprocating the piston.

A passageway 37 is provided between a source of pressurized fluid S and the intermediate chamber 35 such that, at all positions of the piston 25 between the lowermost and the uppermost operating positions, the source of pressurized fluid is in flow communication with the intermediate chamber through the passageway. An opening 39 in the piston at least partially defines the passageway 37. The opening 39 may include a radial opening 49, however, the opening 39 does not have to be an entirely radial opening, i.e., it may have an axial component.

In the embodiment of FIGS. 1A-1E, the piston 25 includes an end opening 41 extending into the piston from an end of the piston, for example, at least the top end 33, and the passageway 37 comprises a feed tube 43 fixed in the casing 23 and partially disposed in the end opening. When the piston 25 reciprocates in the casing 23, the piston and its end opening 41 also move relative to the feed tube 43. The end opening 41 is shown extending along a central axis of the piston 25, however, it will be appreciated that the end opening can be remote from the central axis.

Figure 3:
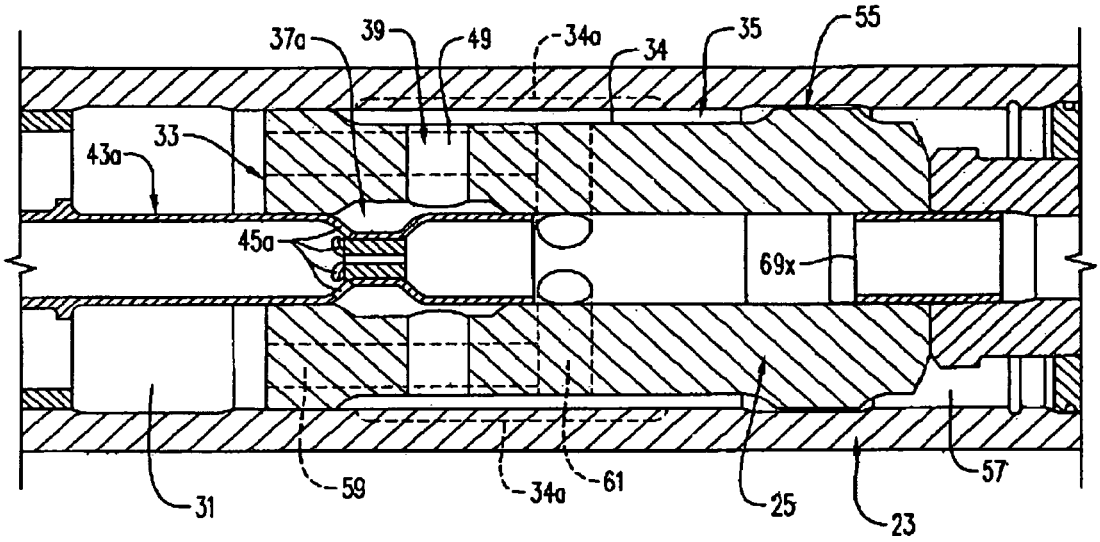
FIG. 3 is a side, cross-sectional view of a down-the-hole hammer according to another embodiment of the present invention.

In the embodiment of FIGS. 1A-1E, the passageway 37 comprises a radial opening 45 in the feed tube 43, although, in other embodiments, such as the embodiment of FIG. 3, a passageway 37*a* may comprise a non-radial opening, such as where the feed tube 43*a* is hourglass shaped and openings 45*a* extend in a substantially axial direction at a top or bottom of a bulb portion of the hourglass. In the embodiment of FIGS. 1A-1E, the passageway 37 comprises a recessed portion 47 in the end opening 41. The passageway 37 also comprises a radial opening 49 between the recessed portion 47 in the end opening 41 and the intermediate chamber 35.

The availability of various modifications relative to the embodiment shown in FIGS. 1A-1E will be appreciated by persons skilled in the art. For example, as seen in FIG. 3, a passageway can comprise a recessed portion in the feed tube, such as in an hourglass-shaped feed tube 43*a*, that permits communication between a radial opening and/or a non-radial opening in the feed tube and the radial opening in the piston over a range of relative positions of the feed tube and the piston in much the same manner that the recessed portion 47 in the piston 35 of the embodiment of FIGS. 1A-1E permits communication between the radial opening 45 in the feed tube 43 and the radial opening 49 in the piston over a range of relative positions of the feed tube and the piston. FIG. 3 shows that both the feed tube 43*a* and the piston 25 can be recessed to facilitate communication between the feed tube and the radial opening in the piston, however, in other embodiments (not shown) no recess is provided in the piston.

In the embodiment of FIGS. 1A-1E, the intermediate chamber 35 comprises a recess 34 in the piston 25. The casing 23 includes a top internal recess 51 that permits flow communication between the intermediate chamber 35 and the top chamber 31 defined by the top end 33 of the piston 25 and the casing when the piston is in the uppermost operating position shown in FIG. 1D. The top internal recess 51 permits flow communication between the intermediate chamber 35 and the top chamber 31 over a range of relative positions of the piston 25 and the casing 23. The size of the intermediate chamber 35 can be selected to minimize any pressure drop that may occur upon establishing communication between the intermediate chamber and the top chamber 31 or the bottom chamber 57.

When flow communication is established between the intermediate chamber 35 and the top chamber 31 as the piston 25 rises in the casing 23, pressurized fluid in the feed tube 43 is in constant communication with the intermediate chamber in all operating positions of the piston and the casing and, therefore, pressurized fluid immediately starts flowing into the upper chamber 31. Prior to this, a separate vent passageway 53 leading from the upper chamber 31 is closed. Because the pressurized air entering the upper chamber 31 has no place to vent, the pressurized air can stop the upward movement of the piston 25 and cause the piston to begin moving downward again to the impact position of FIG. 1A.

The casing 23 also includes a bottom internal recess 55 that permits flow communication between the constantly pressurized intermediate chamber 35 and a bottom chamber 57 defined by the nose 27*a* and nose shoulder 27*b* at the bottom end 27 of the piston 25, a guide sleeve 69 in the casing and having an opening in which the nose is adapted to slide, and the casing when the piston is in the lowermost operating position, i.e., the impact position, as seen in FIG. 1A. During downward movement of the piston 25 in the casing 23, flow communication between the intermediate chamber 35 and the bottom chamber 57 is not established substantially until the piston 25 strikes the drill bit 29, or shortly before that position. When the piston 25 is in the impact position, fluid entering the bottom chamber 57 through the space defined by the bottom internal recess 55 and the piston and from the intermediate chamber 35 starts raising the piston toward the uppermost position shown in FIG. 1D.

Figure 1B:
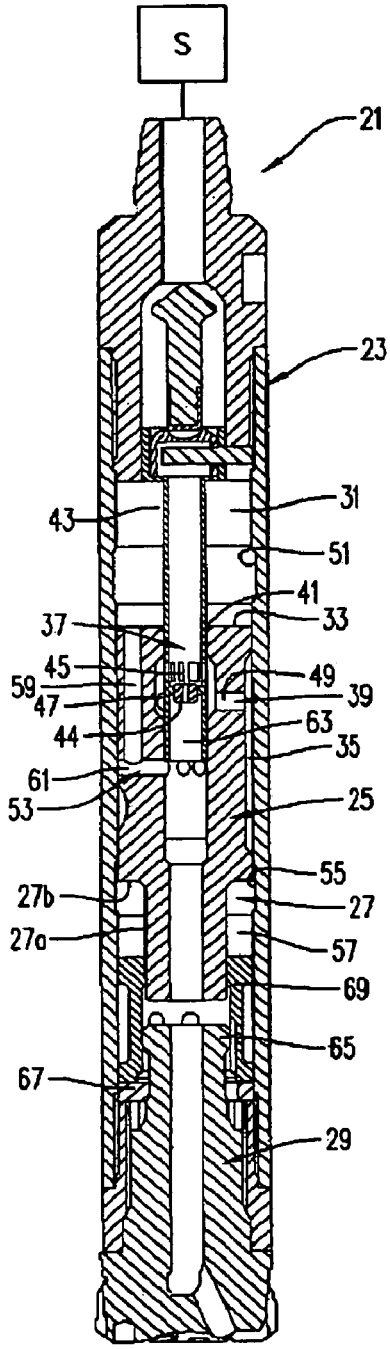
Figure 1C:
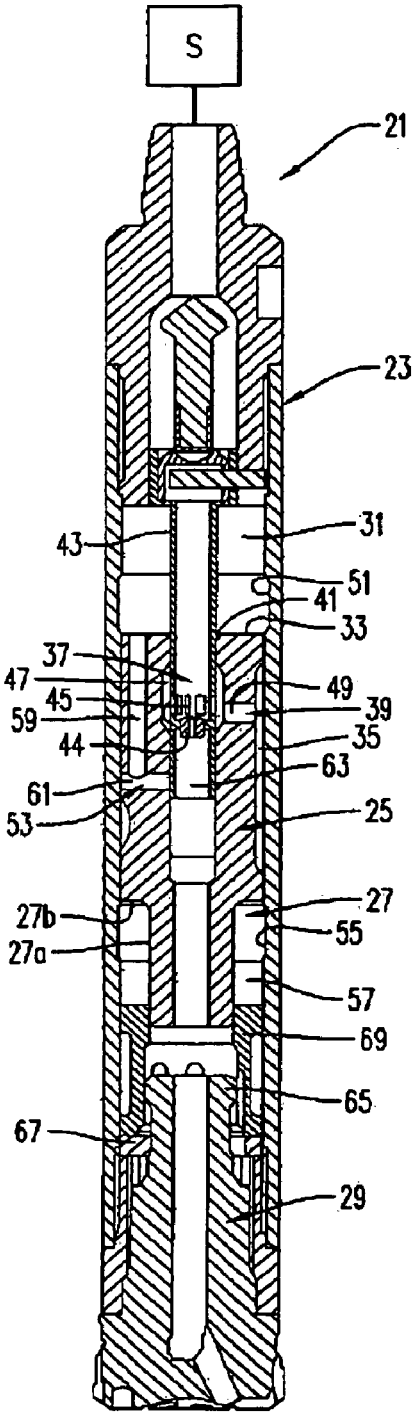
Figure 1D:
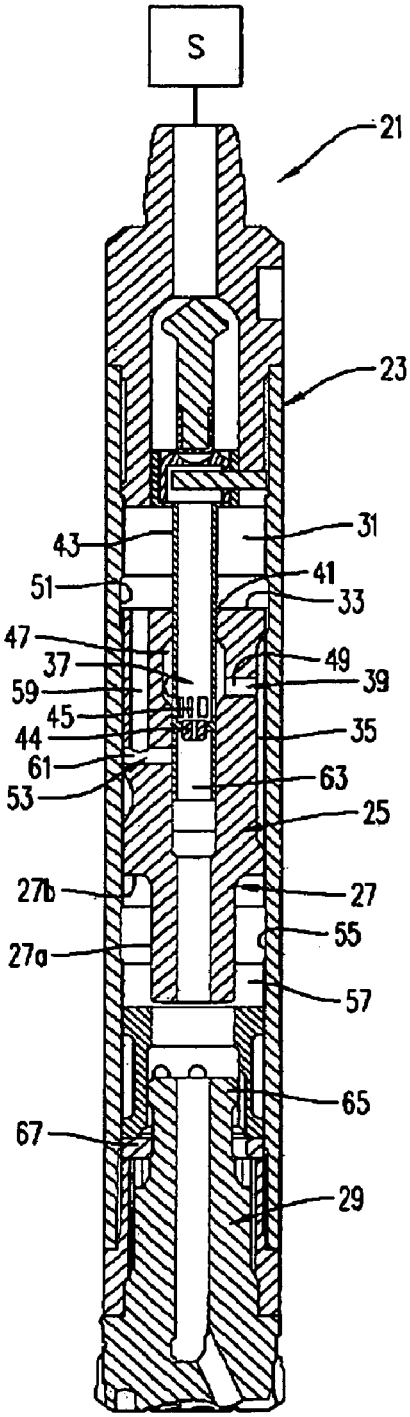
Figure 2A:
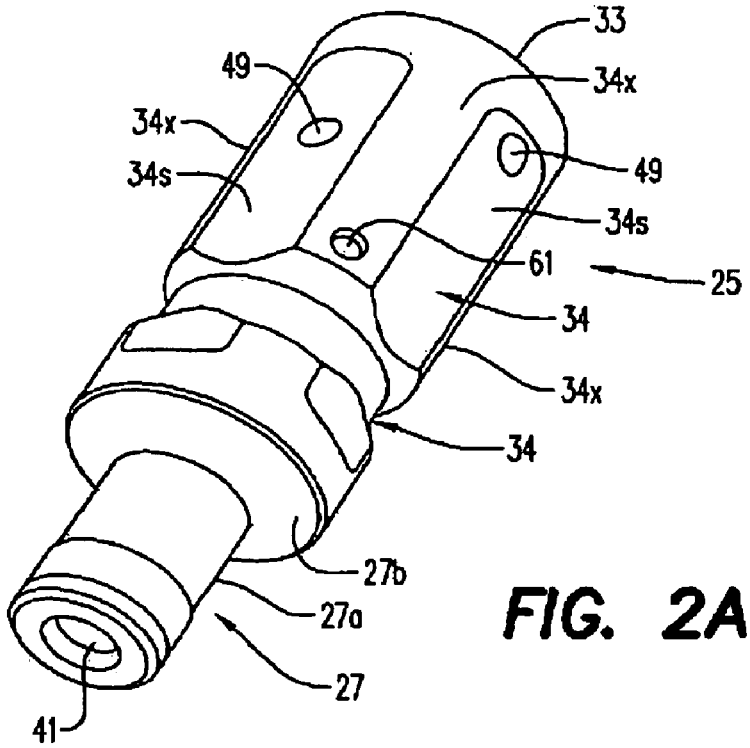
FIGS. 2A and 2B are perspective and top cross-sectional views, respectively, of a piston according to an embodiment of the present invention.
Figure 2B:
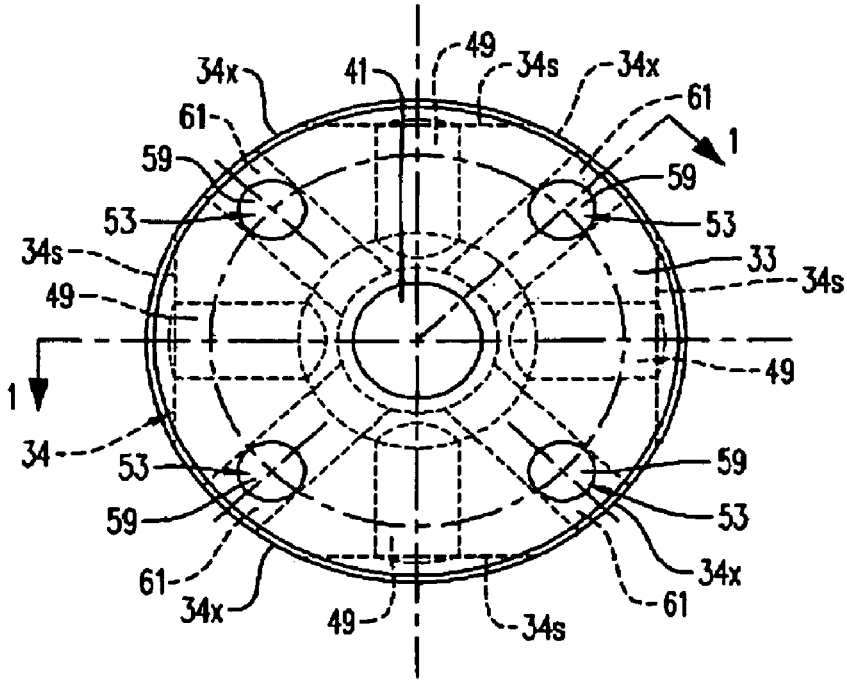

As seen in FIG. 1B, however, when the piston 25 rises in the casing 23 a some predetermined distance, for example, 1" (2.54 cm) above the impact position of FIG. 1A, flow through the space defined by the bottom internal recess 55 and the piston 25 is shut off. When the piston 25 rises above the point where flow to the bottom chamber 57 is shut off, pressure accumulates in the passageway 37 and the intermediate chamber 35 until the piston rises a distance, for example, 3" (7.62 cm) above the impact position as seen in FIG. 1D where flow communication through the space defined by the top internal recess 51 and the piston is established between the intermediate chamber and the top chamber 31.

The end opening 41 in the piston 25 will ordinarily extend from the top end 33 of the piston, through the piston, to the bottom end 27 of the piston. The vent passageway 53 can be provided in the piston to permit flow communication between the top end 33 of the piston and the bottom end 27 of the piston. The vent passageway 53 can include an axial portion 59 extending axially through the piston 25 from the top end 33 and a radial portion 61 extending from the end opening 41 to the axial portion. Thus, fluid can be vented from the top chamber 31 through the axial portion 59 to the radial portion 61 and then on to the end opening 41, where it can vent from the down-the-hole hammer 21 through, for example, vents provided in the drill bit 29. Other embodiments of the vent passageway may include, for example, a single passageway portion that extends from the top of the piston to the end opening at an angle to the axis of the piston, or some combination of axial/angled/radial passages.

The feed tube 43 can be positioned in the end opening 41 such that the feed tube closes flow communication between the top end 33 of the piston 25 and the bottom end 27 of the piston through the vent passageway 53 when the piston is raised a predetermined distance above the lowermost operating position. For example, as seen in FIG. 1B, when the piston 25 is raised relative to the casing 23 to the height at which flow from the intermediate chamber 35 to the bottom chamber 57 is cut off, the end 63 of the feed tube 43 is disposed above the radial portion 61 of the vent passageway 53 and the top chamber 31 is vented through the vent passageway to the end opening 41. However, when the piston 25 rises further relative to the casing 23, for example, to a height of 2" (5.08 cm) as seen in FIG. 1C, the end 63 of the feed tube 43 blocks flow from the vent passageway 53 into the end opening 41. Pressure in the top chamber 31 accumulates as the piston 25 rises but does not substantially impede the upward movement of the piston to its uppermost position, and then pressure substantially increases when the piston rises to the point at which flow communication between the intermediate chamber 35 and the top chamber 31 is established (FIG. 1D) and the downward stroke of the piston begins. A feed tube bleed valve 44 may be provided at a bottom end 63 of the feed tube 43 to facilitate fine tuning of the fluid pressure in the feed tube and various fluid passageways.

During the downward stroke of the piston 25, the sequence of opening and closing communication between the intermediate chamber 35 and the top chamber 31 and the bottom chamber 57, and of opening and closing communication of the top chamber and the end opening 41 through the vent passageway 53, is reversed from the sequence that occurs during the upward stroke. At the uppermost position in FIG. 1D, flow communication between the top chamber 31 and the constantly pressurized intermediate chamber 35 is established through the passage defined by the piston 25 and the top internal recess 51 in the casing 23. The lower end 63 of the feed tube 43 covers the end of the radial portion 61 of the vent passageway 53 at the end opening 41 of the piston 25 and pressure accumulates in the top chamber 31 causing the piston to move downward relative to the casing.

As the piston 25 moves downwardly in the casing 23 from the uppermost position to a lower position shown in FIG. 1C, flow communication between the intermediate chamber 35 and the top chamber 31 is cut off when the recess 34 in the piston descends below the top internal recess in the casing. The lower end 63 of the feed tube 43 continues to seal the end of the radial portion 61 of the vent passageway 53 at the end opening 41 of the piston 25. Pressure accumulates in the passageway 37 and the intermediate chamber 35.

As the piston 25 moves further downward in the casing from the position shown in FIG. 1C to the position shown in FIG. 1B, the piston moves sufficiently downward relative to the lower end 63 of the feed tube 43 such that the radial portion 61 of the vent passageway 53 at the end opening 41 of the piston is unsealed. Pressure in the top chamber 31 can begin to vent from the top chamber through the vent passageway 53. Pressure continues to accumulate in the passageway 37 and the intermediate chamber 35.

Finally, when the piston 25 moves downward from the position shown in FIG. 1B to a position at or near the impact position shown in FIG. 1A, flow communication to the bottom chamber 57 from the intermediate chamber 35 is established through the passage defined by the piston and the bottom internal recess 55 in the casing 23. At the impact position, the fluid entering the bottom chamber 57 is not vented and the piston 25 begins to rise in the casing again.

Directly after impact, pressure in the bottom chamber 57 rises to a pressure sufficient to cause the piston 25 to rise in the casing 23, and fluid in the bottom chamber is permitted to vent, such as through openings in the guide sleeve 69. In other embodiments, however, such as that seen in FIG. 3, a sleeve 69*x* can extend from the drill bit and block venting of the bottom chamber 57 until the piston has risen further, such as when the piston has risen to the point at which flow communication with the intermediate passage 35 is cut off. Fluid in the top chamber 31 continues to be permitted to vent through the vent passageway 53 to the end opening 41 and out through, e.g., vent openings in the drill bit 29.

Because the vent passageway 53 can be provided that is used strictly for venting, and not for fluid supply, and the fluid supply passages can be provided for use strictly for fluid supply, quicker venting and fluid supply can occur than when venting and fluid supply must occur through the same passages and, e.g., valves must be opened and shut in a complicated sequence. Also, because the intermediate chamber 35 can be kept in constant flow communication with the source of pressurized fluid, and because the intermediate chamber can be sized to minimize pressure drop open establishing communication with the top chamber 31 and the bottom chamber 57, it is possible to quickly pressurize the top and bottom chambers upon establishing communication with the intermediate chambers. Further, because fluid flow from the source of pressurized fluid can be caused to occur through a central feed tube 43 that is in constant flow communication with an intermediate chamber 35 formed by a recess 34 in the piston, complex machining and parts typical of down-the-hole hammers having intermediate chambers can be avoided. Also, during upward strokes, pressurized fluid such as line air from the source S of pressurized fluid to the upper chamber 31 is cut off and does not impede upward movement and, during downward strokes, pressurized fluid to the bottom chamber 57 is cut off and does not impede downward movement.

Figure 1E:
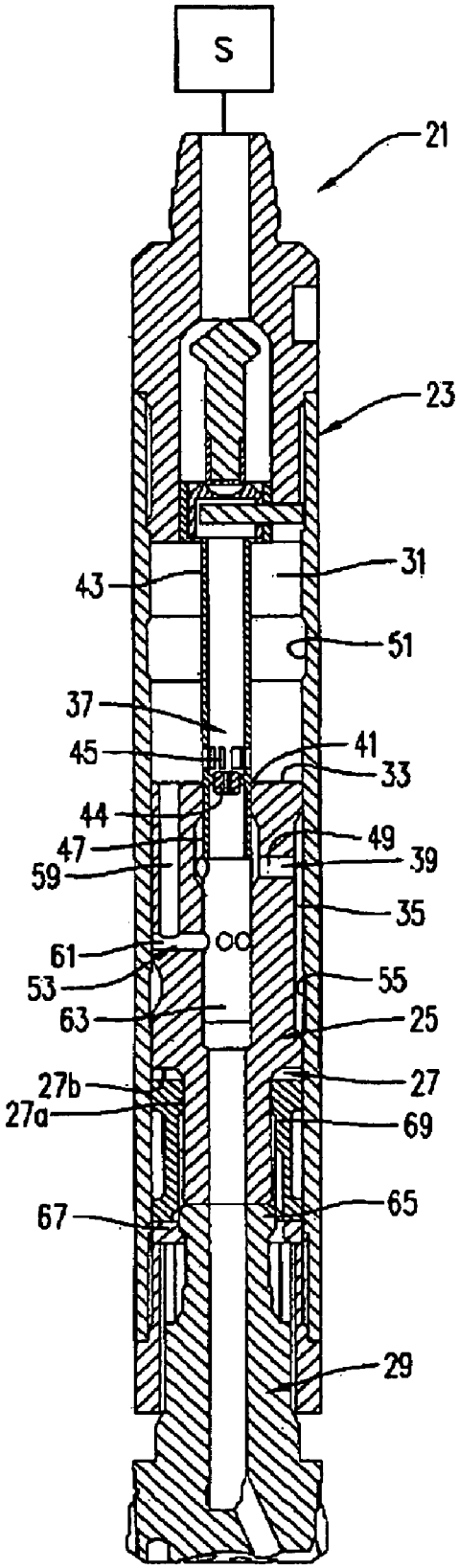

FIG. 1E shows the down-the-hole hammer 21 in a "drop open" position wherein, for example, the drill bit 29 is raised above a surface and is allowed to fall relative to the casing 23 to some predetermined position below the lowermost operating position. In the drop open position, an external radial flange 65 on the drill bit 29 can contact an internal radial flange 67 in the casing 23 to avoid having the drill bit fall out of the casing. In the drop open position, fluid from the source S of pressurized fluid can be permitted to always vent from openings in, e.g., the drill bit 29. As seen in FIG. 1E, in the drop open position, the piston 25 can rest on top of the drill bit 29 in a position wherein flow from the feed tube 43 flows through the radial openings 45 to the upper chamber 31, through the vent passageway 53 to the end opening 41, and out through vent openings in the drill bit 29.

The intermediate chamber 35 is open to the end opening 41, as well. Until the drill bit 29 and piston 25 are raised relative to the casing 23, the piston will not cycle in the casing.

A method of assembling a down-the-hole hammer 21 will be described with reference to the down-the-hole hammer shown in FIGS. 1A-1E, although it will be appreciated that the method can be performed in connection with other down-the-hole hammers, such as the down-the-hole hammer of FIG. 3, as well. The assembly may involve initial assembly of the down-the-hole hammer, repair of the down-the-hole hammer, or refurbishment of the down-the-hole hammer to the extent that the assembly substantially involves reconstruction of the down-the-hole hammer. According to the method, a piston 25 is positioned in a casing 23 such that the piston is movable in the casing between a lowermost operating position and an uppermost operating position. A recess 34 is provided between the piston 25 and the casing 23 so that the piston and the casing define an intermediate chamber 35 between a top end 33 of the piston and a bottom end 27 of the piston. A passageway 37 is provided between a source S of pressurized fluid and the intermediate chamber 35 such that, at all positions of the piston 25 between the lowermost and the uppermost operating positions, the source of pressurized fluid is in flow communication with the intermediate chamber through the passageway. An opening 49 in the piston 35 at least partially defines the passageway 37.

Another method of assembling a down-the-hole hammer 21 will be described with reference to the down-the-hole hammer shown in FIGS. 1A-1E, although it will be appreciated that the method can be performed in connection with other down-the-hole hammers, such as the down-the-hole hammer of FIG. 3, as well. The assembly may involve initial assembly of the down-the-hole hammer, repair of the down-the-hole hammer, or refurbishment of the down-the-hole hammer to the extent that the assembly substantially involves reconstruction of the down-the-hole hammer. According to the method, a casing 23 having a feed tube 43 disposed in the casing is provided. The feed tube 43 is adapted to be connected to a source S of high pressure fluid. A piston 25 is movably positioned in the casing 23 such that the feed tube 43 is movably positioned in an end opening 41 of the piston and such that the piston and the feed tube at least partially define a fluid feed passage 37 for permitting fluid to flow from the feed tube to a top chamber 31 above the piston when in a first range of positions relative to the casing and to a bottom chamber 57 below the piston when in a second range of positions relative to the casing. The piston 25 is further movably positioned such that a fluid vent passage 53 is formed for permitting fluid to vent from the top chamber 31 when the piston is below the first range of positions. The fluid vent passage 53 is at least partially defined by the piston and is discrete from the fluid feed passage 37.

The piston 25 shown in FIGS. 2A-2B has a geometry wherein four recesses 34 are provided in the piston and have surfaces 34*s* that are perpendicular to adjacent ones of the surfaces. In portions 34*x* of the outside peripheral surface of the illustrated piston 25 between the surfaces 34*s*, four channels that form radial portions 61 of a vent passageway 53 are provided that extend to an end opening 41 in the piston. The radial portions 61 of the vent passageway 53 in the illustrated piston 25 are perpendicular to adjacent ones of the radial portions. The radial portions 61, in addition to serving as parts of the vent passageway 53, extend to the outside surface of the piston 25 and thus can facilitate providing lubricant to the casing 23, typically by providing lubricant in the pressurized fluid from the source S of pressurized fluid.

In the present application, the use of terms such as "including" is open-ended and is intended to have the same meaning as terms such as "comprising" and not preclude the presence of other structure, material, or acts. Similarly, though the use of terms such as "can" or "may" is intended to be open-ended and to reflect that structure, material, or acts are not necessary, the failure to use such terms is not intended to reflect that structure, material, or acts are essential. To the extent that structure, material, or acts are presently considered to be essential, they are identified as such.

While this invention has been illustrated and described in accordance with a preferred embodiment, it is recognized that variations and changes may be made therein without departing from the invention as set forth in the claims.

What is claimed is:

1. A down-the-hole hammer, comprising:

a casing;

a piston movable in the casing between a lowermost operating position and an uppermost operating position, a recess being provided between the piston and the casing so that the piston and the casing define an intermediate chamber between a top end of the piston and a bottom end of the piston; and a passageway between a source of pressurized fluid and the intermediate chamber such that, at all positions of the piston between the lowermost and the uppermost operating positions, the source of pressurized fluid is in flow communication with the intermediate chamber through the passageway, an opening in the piston at least partially defining the passageway, wherein the casing includes a top internal recess that permits direct flow communication between the intermediate chamber and a top chamber defined by the top end of the piston and the casing when the piston is in the uppermost operating position.

2. A down-the-hole hammer as set forth in claim 1, wherein the piston includes an end opening extending from an end of the piston, and the passageway comprises a feed tube fixed in the casing and partially disposed in the end opening.

3. A down-the-hole hammer as set forth in claim 2, wherein the passageway comprises a radial opening in the feed tube.

4. A down-the-hole hammer as set forth in claim 3, wherein the passageway comprises a recessed portion in the end opening.

5. A down-the-hole hammer as set forth in claim 4, wherein the passageway comprises a radial opening between the recessed portion in the end opening and the intermediate chamber.

6. A down-the-hole hammer as set forth in claim 4, wherein the passageway comprises a recessed portion in the feed tube.

7. A down-the-hole hammer as set forth in claim 6, wherein the passageway comprises a radial opening between the recessed portion in the feed tube and the intermediate chamber.

8. A down-the-hole hammer as set forth in claim 3, wherein the passageway comprises a recessed portion in the feed tube.

9. A down-the-hole hammer as set forth in claim 8, wherein the passageway comprises a radial opening between the recessed portion in the feed tube and the intermediate chamber.

10. A down-the-hole hammer as set forth in claim 1, wherein the intermediate chamber comprises a recess in the piston.

11. A down-the-hole hammer as set forth in claim 1, wherein the casing includes a bottom internal recess that permits flow communication between the intermediate chamber and a bottom chamber defined by the bottom end of the piston and the casing when the piston is in the lowermost operating position.

12. A down-the-hole hammer as set forth in claim 1, wherein the casing includes a bottom internal recess that permits flow communication between the intermediate chamber and a bottom chamber defined by the bottom end of the piston and the casing when the piston is in the lowermost operating position.

13. A down-the-hole hammer as set forth in claim 1, wherein the piston includes an end opening extending from the top end of the piston, through the piston, to the bottom end of the piston.

14. A down-the-hole hammer as set forth in claim 13, comprising a vent passageway in the piston, the vent passageway being adapted to permit flow communication between the top end of the piston and the bottom end of the piston.

15. A down-the-hole hammer as set forth in claim 14, wherein the passageway comprises a feed tube fixed in the casing and partially disposed in the end opening, the feed tube being positioned in the end opening such that the feed tube closes flow communication between the top end of the piston and the bottom end of the piston through the vent passageway when the piston is raised a predetermined distance above the lowermost operating position.

16. A down-the-hole hammer as set forth in claim 14, wherein the end opening extends along a central axis of the piston.

17. A down-the-hole hammer, comprising:

a casing;

a feed tube disposed in the casing and adapted to be connected to a source of high pressure fluid;

a piston movable in the casing and having an end opening in which the feed tube is movable upon reciprocation of the piston;

a fluid feed passage at least partially defined by the piston for permitting fluid to flow from the feed tube to a top chamber above the piston when in a first range of positions relative to the casing and to a bottom chamber below the piston when in a second range of positions relative to the casing; and a fluid vent passage for permitting fluid to vent from the top chamber when the piston is below the first range of positions, the fluid vent passage being at least partially defined by the piston and discrete from the fluid feed passage.

18. A down-the-hole hammer as set forth in claim 17, wherein the fluid feed passage comprises a radial opening in the feed tube.

19. A down-the-hole hammer as set forth in claim 18, wherein the fluid feed passage comprises a recess between the piston and the casing so that the piston and the casing define an intermediate chamber between a top end of the piston and a bottom end of the piston.

20. A down-the-hole hammer as set forth in claim 19, wherein the fluid feed passage comprises a radial opening in the piston between the intermediate chamber and the radial opening in the feed tube.

21. A down-the-hole hammer as set forth in claim 20, wherein the fluid vent passage is arranged to vent air from the top chamber into the bottom chamber and is at least partially defined by the end opening, the end opening extending to the bottom end of the piston, the feed tube being positioned in the end opening such that the feed tube blocks flow communication between the top chamber and the bottom chamber when the piston is raised a predetermined distance above a lowermost operating position.

22. A down-the-hole hammer as set forth in claim 17, wherein the fluid feed passage comprises a recess between the piston and the casing so that the piston and the casing define an intermediate chamber between a top end of the piston and a bottom end of the piston.

23. A down-the-hole hammer as set forth in claim 22, wherein the fluid vent passage is arranged to vent air from the top chamber into the bottom chamber and is at least partially defined by the end opening, the end opening extending to the bottom end of the piston, the feed tube being positioned in the end opening such that the feed tube blocks flow communication between the top chamber and the bottom chamber when the piston is raised a predetermined distance above a lowermost operating position.

24. A piston for a down-the-hole hammer, comprising:

a body having a top end and a bottom end and an intermediate surface between the top end and the bottom end, the top end having a top surface and the bottom end having a bottom surface at ends thereof;

an opening extending from the top end to the bottom end of the body, the opening having a primary diameter and a recessed portion having a diameter larger than the primary diameter;

a radial passage extending from the opening to the intermediate surface;

a passage extending from the top end to the opening, the passage comprising an axially extending hole extending substantially parallel to the opening and a radially extending hole extending substantially perpendicular to the opening; and a recess in the intermediate surface below the top end and above the bottom end, the radial passage extending from the opening to the recess in the intermediate surface, a length of the recess being substantially greater than a length of a distance between the recess and the top surface and than a length of a distance between the recess and the bottom surface.

25. A piston for a down-the-hole hammer as set forth in claim 24, wherein the radial passage extends from the recessed portion to the intermediate surface.

26. A piston for a down-the-hole hammer as set forth in claim 24, wherein the passage includes an axial portion extending from the top end and a radial portion extending from the axial portion to the opening.

27. A method of assembling a down-the-hole hammer, comprising:

positioning a piston in a casing such that the piston is movable in the casing between a lowermost operating position and an uppermost operating position, a recess being provided between the piston and the casing so that the piston and the casing define an intermediate chamber between a top end of the piston and a bottom end of the piston;

providing a passageway between a source of pressurized fluid and the intermediate chamber such that, at all positions of the piston between the lowermost and the uppermost operating positions, the source of pressurized fluid is in flow communication with the intermediate chamber through the passageway, an opening in the piston at least partially defining the passageway; and providing a top internal recess in the casing that permits direct flow communication between the intermediate chamber and a top chamber defined by the top end of the piston and the casing when the piston is in the uppermost operating position.

28. A method of assembling a down-the-hole hammer, comprising:

providing a casing having a feed tube disposed in the casing, the feed tube being adapted to be connected to a source of high pressure fluid; and movably positioning a piston in the casing such that the feed tube is movably positioned in an end opening of the piston and such that the piston and the feed tube at least partially define a fluid feed passage for permitting fluid to flow from the feed tube to a top chamber above the piston when in a first range of positions relative to the casing and to a bottom chamber below the piston when in a second range of positions relative to the casing, and such that a fluid vent passage is formed for permitting fluid to vent from the top chamber when the piston is below the first range of positions, the fluid vent passage being at least partially defined by the piston and discrete from the fluid feed passage.

* * * * *